US005333533A

United States Patent [19]

Hosseini

[11] Patent Number: 5,333,533

[45] Date of Patent: Aug. 2, 1994

[54] METHOD AND APPARATUS FOR CONTROLLING AN IMPLEMENT

[75] Inventor: Javad Hosseini, Peoria, Ill.

[73] Assignee: Caterpillar Inc., Peoria, Ill.

[21] Appl. No.: 889,571

[22] Filed: May 28, 1992

Related U.S. Application Data

[63] Continuation-in-part of Ser. No. 759,390, Sep. 13, 1991.

[51] Int. Cl.[5] ..... F15B 13/16

[52] U.S. Cl. ..... 91/361; 71/367; 71/435; 60/469

[58] Field of Search ..... 60/414,469; 91/361, 91/367, 435, 453

[56] References Cited

U.S. PATENT DOCUMENTS 3,789,739 2/1974 Krehbiel et al. ..... 91/461
4,015,729 4/1977 Parquet et al. .
4,109,812 8/1978 Adams et al. .
4,358,989 11/1982 Tordenmalm .
4,552,503 11/1985 Mouri et al. .
4,643,074 2/1987 Gunda et al. ..... 91/361
4,844,685 7/1989 Sagaser .
5,195,864 3/1993 Drake et al. ..... 60/469

FOREIGN PATENT DOCUMENTS 2225127 5/1990 United Kingdom .

*Primary Examiner*—Edward K. Look
*Assistant Examiner*—F. Daniel Lopez
*Attorney, Agent, or Firm*—R. Carl Wilbur

[57] ABSTRACT

An implement control system is provided for controllably raising and lowering an implement relative to a work vehicle. The implement is pivotally connected to the work vehicle and movable between maximum raised and lowered positions in response to the extension and retraction of a hydraulic cylinder. The implement control system is operative for controllably connecting the hydraulic cylinder to a hydraulic accumulator as the implement reaches its desired position, thereby slowing movement of the implement in a smooth manner.

25 Claims, 5 Drawing Sheets

Cylinder Extension Sensor
Cylinder Extension Sensor
Main Valve
Fluid Reserve
Pilot Supply
Controller
Detent Mechanism
Lever Pilot Valve
Position Sensor
10
18
18
22
23
24
25
26
28
32
34
35
36
38
40
42
44
46
48
50
52
54
56
58
60
62
66
68a
68b
70
72

18
60
18
58
10
54
56
48
Main Valve
50
52
23
Cylinder Extension Sensor
22
Cylinder Extension Sensor
24
Controller
68b
66
68a
62
Fluid Reserve
Pilot Supply
25
70
72
32
34
26
Detent Mechanism
Lever Pilot Valve
35
28
36
Position Sensor

METHOD AND APPARATUS FOR CONTROLLING AN IMPLEMENT

CROSS-REFERENCE TO RELATED APPLICATIONS

This patent is a Continuation-In-Part of patent application Ser. No. 07/759,390 which was filed on Sep. 13, 1991 by Hosseini et al.

TECHNICAL FIELD

This invention relates generally to an apparatus for controlling the extension and retraction of a hydraulic cylinder, and more particularly to an apparatus for reducing the speed at which a hydraulic cylinder is extending or retracting.

BACKGROUND ART

Vehicles such as wheel type loaders include work implements capable of being moved through a number of positions during a work cycle. Such implements typically include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket.

Control levers are mounted at the operator's station and are connected to a hydraulic circuit for moving the bucket and/or lift arms. The operator must manually move the control levers to open and close hydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to flow to the head end of a lift cylinder thus causing the lift arms to rise. When the control lever returns to a neutral position, the hydraulic valve closes and pressurized fluid no longer flows to the lift cylinder.

In normal operation, the implement is often brought to an abrupt stop after performing a given work cycle function. This can occur, for example, when the implement is moved to the end of its range of motion. If the lift arms or hydraulic cylinders impact with a mechanical stop, significant forces are absorbed by the lift arm assembly and the hydraulic circuit. This results in increased maintenance and accelerated failure of associated parts.

A similar situation occurs when a control system holds the control lever in a detent position at which the associated hydraulic valve is held open until the lift arm assembly or implement reaches a predetermined position. The control system then releases the control lever which is spring biased to the neutral position. The springs quickly move the control lever to the neutral position which in turn abruptly closes the associated hydraulic valve. Thus, the lift arm assembly and/or bucket is brought to an abrupt stop. Such abrupt stops result in stresses being exerted on the hydraulic cylinders and implement linkage from the inertia of the bucket, lift arm assembly, and load. The abrupt stops also reduce operator comfort and increase operator fatigue.

Stresses are also produced when the vehicle is lowering a load and the operator quickly closes the associated hydraulic valve. The inertia of the load and implement exerts forces on the lift arm assembly and hydraulic system when the associated hydraulic valve is quickly closed and the motion of the lift arms is abruptly stopped. Such stops cause increased wear on the vehicle and reduce operator comfort. In some situations, the rear of the tractor can even be raised off the ground.

To reduce these stresses, systems have been developed to more slowly and smoothly stop the motion of the implement in these situations. One solution to this problem is disclosed in U.S. Pat. No. 4,109,812, issued to Adams et al. on Aug. 29, 1978. A device is provided for halting the flow of hydraulic fluid to the cylinders just prior to the lift arms reaching the end of their range of motion and trapping fluid within the cylinder to act as a hydraulic cushion. While this approach is acceptable for slowing the implement before it reaches a mechanical stop, this device is not readily adapted to use with a control system that stops the implement at adjustable kickout positions. Such kickout positions are chosen in response to the parameters of the work cycle and are typically different from the maximum raise and lower positions. Such a hydraulic cushion is also not readily controllable in response to changes in operating conditions.

An alternative system is disclosed in U.S. Pat. No. 4,358,989, issued to Tordenmalm on Nov. 16, 1982. This system utilizes an electrohydraulic valve to extend and retract a piston within a hydraulic cylinder. When the piston reaches a position that is a predetermined distance from the end of stroke, the control system progressively closes the electrohydraulic valve as the piston continues to move toward the end of stroke. While this system adequately reduces the velocity of the piston before it reaches a hard stop, it is not operable to perform other desirable implement functions, such as adjusting kickout positions and defining multiple raise kickout positions. Also, if the electronic system fails, the operator is unable to operate the hydraulic cylinders.

The present invention is directed to overcoming one or more of the problems set forth above.

DISCLOSURE OF THE INVENTION

The invention avoids the disadvantages of known implement controls and provides a system for controllably reducing the speed of a hydraulically operated work implement. The instant invention combines the advantages of hydraulic and electrohydraulic implement controls to provide a reliable and flexible implement control system.

In one aspect of the present invention an apparatus is provided for controllably raising and lowering an implement which is connected to a work vehicle and movable between maximum raised and lowered positions in response to the extension and retraction of a hydraulic cylinder. The apparatus includes a hydraulic accumulator. A sensor is adapted to sense the position of the implement with respect to the work vehicle and responsively produce an implement position signal. A kickout device is provided for selecting a kickout position and responsively producing a kickout position signal. A control lever is normally biased to a neutral position and is movable between raise and lower detent positions. A lever position sensor is adapted to sense the position of the control lever and responsively produce a lever position signal. A lever operated pilot valve is connected to the control lever and is adapted to produce a lever pilot pressure in response to the position of the control lever. A detent mechanism is adapted to maintain the control lever at either of its detent positions when the control lever is manually moved to a respective detent position. The detent mechanism is further adapted to receive a detent release signal and release the control lever from the detent position in response to the detent release signal. A controller is adapted to receive the implement and control lever position signals, produce a detent signal in response to the control lever position signal indicating that the control lever is in one of the detent positions, produce a difference signal in response to a difference between the implement and kickout position signals, produce an open signal and a detent release signal when the difference signal between first and second thresholds, and produce a control signal in response to production of the detent signal, the control signal having a magnitude responsive to the difference signal. An accumulator control device is provided for receiving the open signal and permitting hydraulic fluid flow between the hydraulic cylinder and the accumulator in response to the open signal and preventing hydraulic fluid flow between the hydraulic cylinder and the hydraulic accumulator in the absence of the open signal. A first valve is provided for receiving the control signal and producing an electrohydraulic pilot pressure in response to the control signal. A second valve is provided for receiving the lever and electrohydraulic pilot pressures and controlling the extension of the hydraulic cylinder in response to the greater of the two pressures.

In a second aspect of the present invention, an apparatus is provided for controllably raising and lowering an implement which is connected to a work vehicle and movable between maximum raised and lowered positions in response to the extension and retraction of a hydraulic cylinder. The apparatus includes a hydraulic accumulator. A sensor is adapted to sense the position of the implement with respect to the work vehicle and responsively produce an implement position signal. A kickout device is provided for selecting a kickout position and responsively producing a kickout position signal. A control lever is normally biased to a neutral position and is movable between raise and lower detent positions. A lever position sensor is adapted to sense the position of the control lever and responsively produce a lever position signal. A lever operated pilot valve is connected to the control lever and is adapted to produce a lever pilot pressure responsive to the position of the control lever. A detent mechanism is adapted to maintain the control lever at either of its detent positions when the control lever is manually moved to a respective detent position. The detent mechanism is further adapted to receive a detent release signal and release the control lever from the detent position in response to the detent release signal. A controller is being adapted to receive the implement and control lever position signals, produce a detent signal in response to the control lever position signal indicating that the control lever is in one of the detent positions, produce a difference signal in response to a difference between the implement and kickout position signals, and produce an open signal and a detent release signal when the difference signal is between first and second thresholds. An accumulator control device is provided for receiving the open signal and permitting hydraulic fluid flow between the hydraulic cylinder and the accumulator in response to the open signal and preventing hydraulic fluid flow between the hydraulic cylinder and the hydraulic accumulator in the absence of the open signal. A valve means is provided for receiving the lever pilot pressures and controlling the extension of the hydraulic cylinder in response to received pressure.

In a third aspect of the present invention, an apparatus is provided for controllably raising and lowering an implement which is connected to a work vehicle and movable between maximum raised and lowered positions in response to the extension and retraction of a hydraulic cylinder. The apparatus includes a hydraulic accumulator and a sensor adapted to sense the position of the implement with respect to the work vehicle and responsively produce an implement position signal. A device is provided for producing a desired position signal which corresponds to a desired implement position. A controller is adapted to receive the implement and desired position signals, produce a difference signal in response to a difference between the implement and desired position signals, produce an open signal when the difference signal is between first and second thresholds, and produce a control signal having a magnitude responsive to the difference signal. An accumulator control device is provided for receiving the accumulator open signal and permitting hydraulic fluid flow between the hydraulic cylinder and the accumulator in response to the open signal and preventing hydraulic fluid flow between the lift cylinder and the hydraulic accumulator in the absence of the open signal. A valve is provided for receiving the control signal and controlling the extension of the hydraulic cylinder in response to the control signal.

The invention also includes other features and advantages which will become apparent from a more detailed study of the drawings, specification and appended claims.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
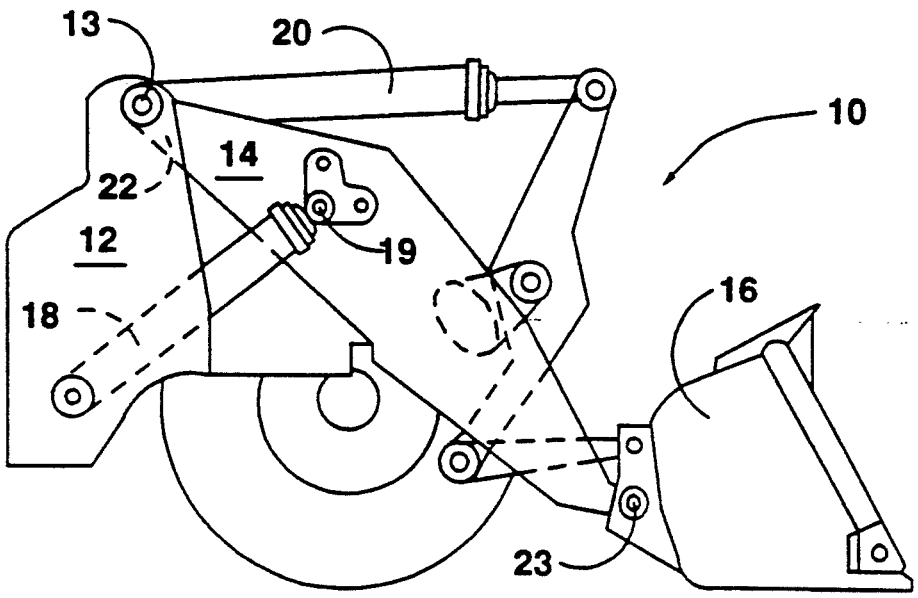
FIG. 1 is a side view of the forward portion of a loader vehicle.

In FIG. 1 an implement control system is generally represented by the element number 10. Although FIG. 1 shows a forward portion of a wheel type loader vehicle 12 having a payload carrier in the form of a bucket 16, the present invention is equally applicable to vehicles such as track type loaders, hydraulic excavators, and other vehicles having similar loading implements. The bucket 16 is connected to a lift arm assembly 14, which is pivotally actuated by two hydraulic lift cylinders 18 (only one of which is shown) about a pair of lift arm pivot pins 13 (only one shown) attached to the vehicle frame. A pair of lift arm load bearing pivot pins 19 (only one shown) are attached to the lift arm assembly 14 and the lift cylinders 18. The bucket 16 can also be tilted by a bucket tilt cylinder 20. A lift cylinder extension sensor 22 is included in connection with the lift cylinders 18 and a tilt cylinder extension sensor 23 is included in connection with the tilt cylinder 20.

In the preferred embodiment, the lift and tilt cylinder extension sensors 22,23 are rotary potentiometers connected to and between the lift arm pivot pins 13 and the lift arm assembly 14. The rotary potentiometers are adapted to produce pulse width modulated signals in response to the angular position of the lift arms with respect to the vehicle and the bucket 16 with respect to the lift arm assembly 14. Since the angular position of the lift arms is a function of lift cylinder extension, the signal produced by the rotary potentiometer in the lift cylinder extension sensor 22 is a function of lift cylinder extension. Similarly, since the angular position of the bucket 16 is a function of tilt cylinder extension, the signal produced by the rotary potentiometer in the tilt cylinder extension sensor 23 is a function of tilt cylinder extension. The functions of the extension sensors 22,23 can readily be any other sensor which are capable of measuring, either directly or indirectly, the relative extension of a hydraulic cylinder. For example, the potentiometers could be replaced with radio frequency (RF) sensors disposed within the hydraulic cylinders 18.

Figure 2:
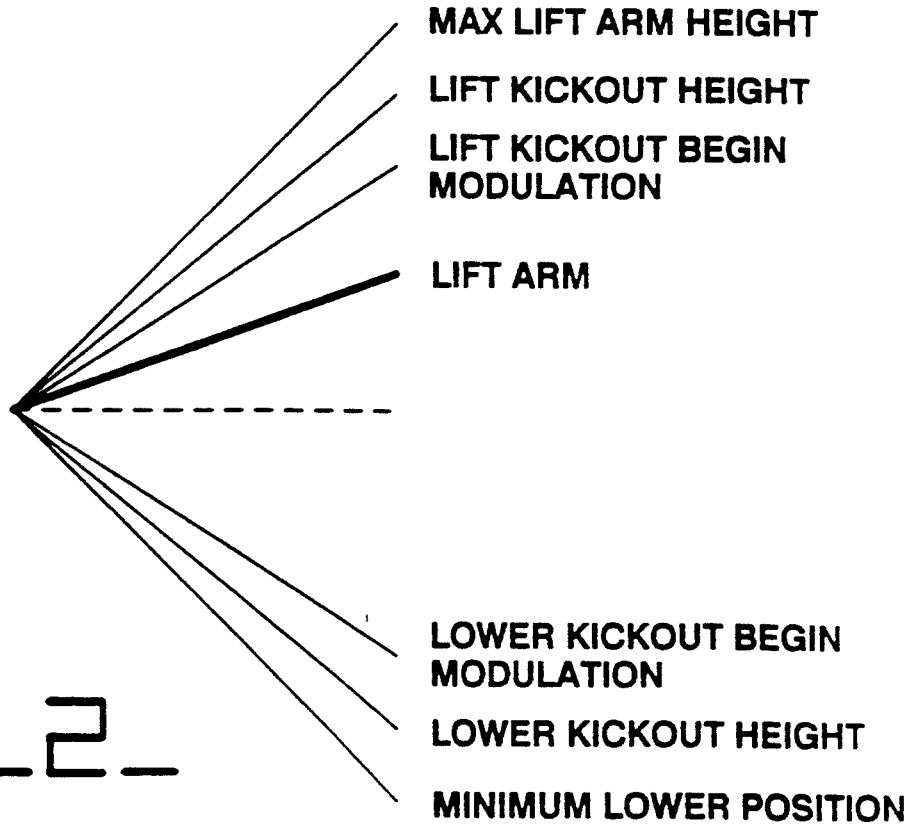
FIG. 2 illustrates a plurality of positions through which the lift arms of a work vehicle are moved.

FIG. 2 diagrammatically illustrates the range of motion of the lift arm assembly 14 and a plurality of intermediate positions through which the lift arm assembly 14 is moved during a work cycle. The maximum lift arm height is the position of the lift arm assembly 14 at which a mechanical stop prevents the lift cylinders 18 from further raising the bucket 16. Similarly, the minimum lower position is the position of the lift arm assembly 14 at which a mechanical stop prevents the lift cylinders 18 from further lowering the bucket 16. A midpoint is shown generally by the dashed line in FIG. 2 and substantially bisects the range of motion of the lift arm assembly 14 which is defined by the maximum lift arm height and the minimum lower position.

The lift and lower kickout heights illustrate positions to which the lift arm assembly 14 is to be moved while performing a work cycle. For example, the lift kickout height corresponds to the desired dump height for the bucket 16, and the lower kickout height corresponds to the return-to-dig position for the bucket 16. Advantageously, the lift and lower kickout heights can be selected by the operator at the beginning of a work cycle and are changeable in response to the parameters of the particular work cycle being performed.

The lift and lower kickout begin-modulation-positions correspond to the positions of the lift arm assembly 14 at which the implement control system 10 begins to reduce the speed of the bucket 16. The begin-modulation-positions are advantageously selected to allow the implement control system to completely stop the bucket 16 at the appropriate kickout height without unduly stressing the lift arm assembly 14 or reducing operator comfort.

Figure 3:
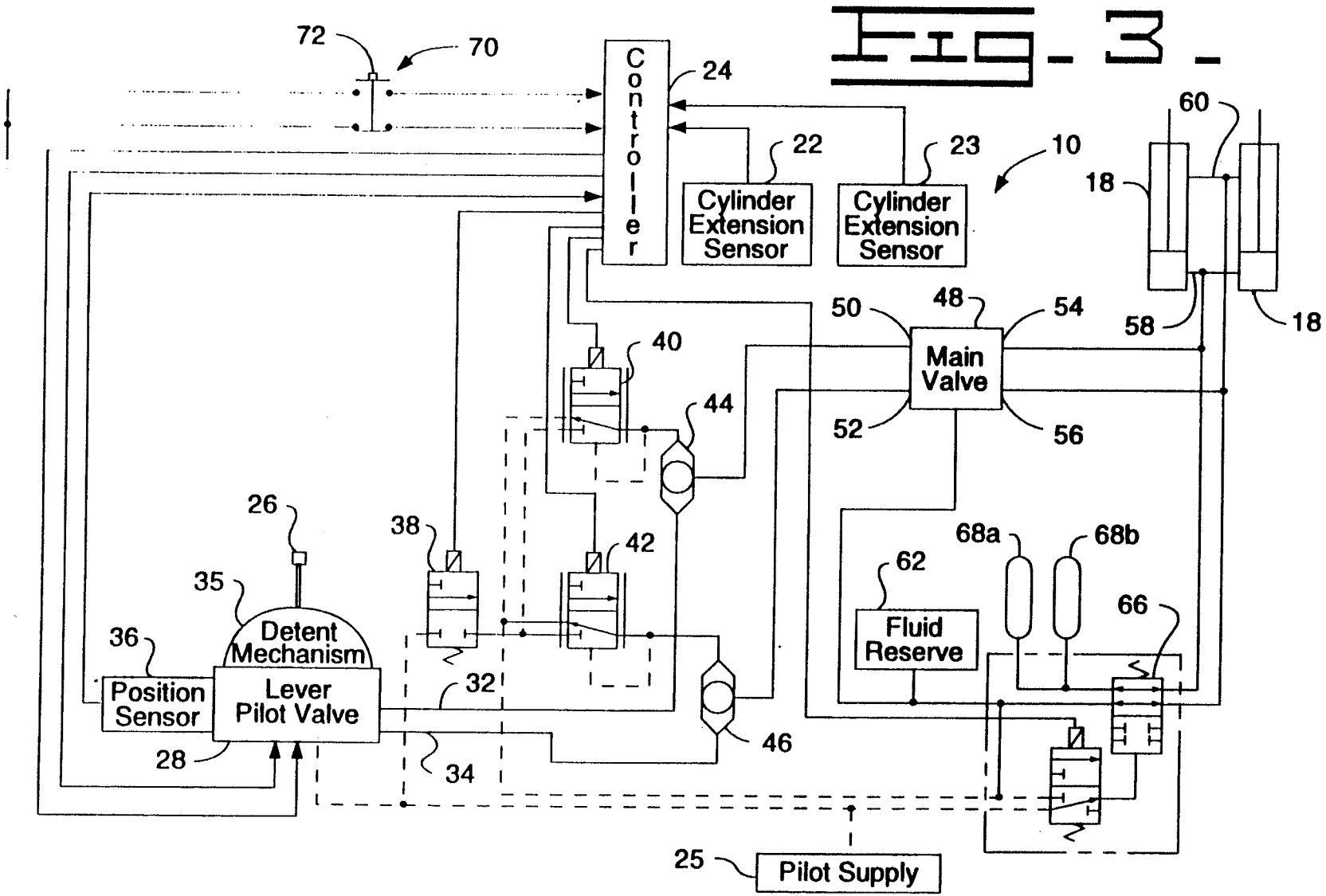
FIG. 3 is a diagrammatic illustration of a first embodiment of the present invention.

Referring now to FIG. 3, a first embodiment of the implement control system 10 is diagrammatically illustrated. The control system 10 includes a controller 24 which is adapted to sense a plurality of inputs and responsively produce output signals which are delivered to various actuators in the control system. Preferably, the controller 24 is in the form of a commercially available microprocessor such as a model MC68000 as manufactured by Motorola Inc. of Schaumburg, Ill.

A control lever 26 is connected to a lever operated pilot valve 28 which is adapted to receive pressurized fluid from a pilot supply source 25 and operate on the pressurized fluid to produce a lever pilot pressure in response to the position of the control lever 26. The control lever 26 is normally spring biased to a neutral position at which the lever pilot pressure is not produced. The control lever 26 is movable in first and second directions corresponding to raise and lower, respectively. These directional terms are used purely for illustration and should not be construed as limiting the scope of the present invention. The pilot valve 28 is adapted to direct lever pilot pressure to a raise pilot line 32 in response to the control lever 26 being moved in the first direction and to a lower pilot line 34 in response to the control lever 26 being moved in the second direction. The magnitude of the pilot pressure is proportional to the distance the control lever 26 is displaced from the neutral position.

A detent mechanism 35 is actuatable to hold the control lever 26 in predetermined raise and lower detent positions in response to the control lever 26 being moved to or beyond a respective detent position. Since the velocity of the implement is a function of control lever position, the raise and lower detent positions are chosen in response to design preferences regarding the desired velocity of the implement while the work cycle is being performed. The detent mechanism 26 includes solenoids (not shown) for controllably releasing the control lever 26 from the raise and lower detent positions in response to receiving a detent release signal from a controller 24. Typically, the detent release signal is produced in response to the lift arm assembly 14 being moved to the kickout begin-modulation-position.

A control lever position sensor 36 is adapted to sense the position of the control lever 26 and produce an electrical signal responsive to the sensed lever position. The electrical signal is delivered to an input of the controller 24. The control lever position sensor 36 preferably includes a rotary potentiometer which produces a pulse width modulated signal in response to the pivotal position of the control lever 26; however, any sensor that is capable of producing an electrical signal in response to the pivotal position of the control lever would be operable with the instant invention.

An electrohydraulic pilot supply valve 38 is electrically connected to the controller 24 and adapted to receive electrical output signals from the controller 24. The pilot supply valve 38 is hydraulically connected between the pilot supply source 25 and raise and lower electrohydraulic pilot control valves 40,42. The pilot supply valve 38 is included to control the flow of pressurized fluid to the pilot control valves 40,42 from the pilot supply source 25. The pilot supply valve 38 is preferably a normally closed on/off pilot valve. The controller 24 is adapted to normally maintain the pilot supply valve 38 in an energized or open state in which pressurized fluid is directed to the electrohydraulic pilot valves 40,42. The controller 24 is further adapted to deenergize or close the pilot supply valve 38 in response to preselected fault conditions, thereby stopping the flow of pressurized fluid to the pilot control valves 40,42.

The pilot control valves 40,42 are preferably proportional pilot pressure control valves as are common in the art. Outputs of the pilot control valves 40,42 are connected to inputs of respective raise and lower hydraulic resolvers 44,46. The pilot control valves 40,42 are electrically connected to the controller 24 for receiving valve control signals therefrom. The electrohydraulic pilot control valves 40,42 are continuously variable between fully opened at which the resulting electrohydraulic pilot pressure directed toward the resolvers 44,46 is at maximum pilot pressure and a closed position at which the pilot pressure is substantially zero pressure. The degree a respective control valve is opened is responsive to the magnitude of the control signal (i.e. current) received from the controller 24, as would be apparent to one skilled in the art.

The raise and lower resolvers 44,46 further have inputs connected to the raise and lower pilot lines 32,34, respectively. Each of the resolvers 44,46 is adapted to direct the greater of the electrohydraulic and lever pilot pressures to a main valve 48. For this purpose, the main valve 48 has raise and lower input ports 50,52 which are respectively connected to outputs of the raise and lower resolver 44,46. The raise resolver 44 receives the electrohydraulic pilot pressure from the raise electrohydraulic pilot valve 40 and the lever pilot pressure from the raise pilot line 32. The raise resolver 44 applies the pilot pressure having the greater pressure to the main valve raise port 50. Thus, if the lever pilot pressure exceeds the electrohydraulic pilot pressure, the main valve 48 is controlled in response to the position of the control lever 26. Conversely, if the electrohydraulic pilot pressure is greater than the lever pilot pressure, the main valve 48 is controlled in response to the magnitude of control signal produced by the controller 24. While the operation of only the raise resolver 44 has been described, it should be appreciated that the lower resolver 46 operates in a similar fashion.

The main valve 48 is further hydraulically connected to a hydraulic pump (not shown) for receiving a supply pressure therefrom. The main valve 48 has raise and lower output ports 54,56 respectively connected to the head and rod ends 58,60 of the lift cylinders 18. The main valve 48 operates on the supply pressure to controllably direct pressurized fluid to the head end 58 and rod end 60 of the lift cylinders 18 in response to receiving pilot pressures in the raise and lower ports 50,52, respectively.

An electrohydraulic pilot valve 64 is hydraulically connected between a pilot actuated accumulator control valve 66 and the pilot supply source 25. The pilot valve 64 is electrically connected to the controller 24 and adapted to receive an electrical signal from the controller 24. The pilot valve 64 is normally biased to a first position as shown in the absence of the electrical control signal. In the first position, the pilot valve 64 directs pressurized fluid from the pilot supply source 25 to the control valve 66. When the pilot valve 64 receives the electrical control signal or "open" signal from the controller 24, the pilot valve 64 is biased to its second position where pressurized fluid is prevented from flowing between the pilot supply source 25 and the control valve 66.

The control valve 66 hydraulically connects the lift cylinders 18 to a pair of accumulators **68*a,b* and the fluid reservoir 62. The preferred embodiment includes two accumulators 68*a,b*; however, it should be appreciated that the number of accumulators required will vary depending on the size and capacity of the associated hydraulic system. The control valve 66 controllably connects the rod end 60 to the fluid reservoir 62 and the head end 58 to the accumulators 68*a,b*,** as is explained below.

The control valve 66 is a pilot operated valve of a type well-known in the art and is controllably movable between first and second positions. The control valve 66 is normally biased to the first position, as shown, in the absence of pilot pressure from the pilot valve 64. In the first (open) position, hydraulic fluid is allowed to pass between the rod end 60 and the fluid reservoir 62 and between the head end 58 and the accumulators **68*a,b*. If pilot pressure is applied to the control valve 66 from the pilot valve 64, the control valve 66 is biased to its second (closed) position. When the control valve 64 is closed, hydraulic fluid is prevented from passing between the rod end 60 and the fluid reservoir 62 and between the head end 58 and the accumulators 68*a,b***.

The pilot valve 64 and control valve 66 are shown as they would exist in the absence of pilot pressure from the pilot supply source 25 (i.e., when the vehicle is not operating.) When the vehicle is operating, the pilot supply source 25 supplies the pilot pressure to the pilot valve 64. Since the pilot valve 64 is normally biased to its first position, the pilot pressure is delivered to the control valve 66. The pilot pressure biases the control valve 66 to its second (closed) position, thereby preventing hydraulic fluid from passing between the rod end 60 and the fluid reservoir 62 and between the head end 58 and the accumulators **68*a,b***.

The accumulators **68*a,b* are activated in response to the "open" signal being delivered to the pilot valve 64. More specifically, the "open" signal biases the pilot valve 64 to its second position, thereby cutting the pilot supply pressure to the control valve 66. In the absence of the pilot supply pressure, the control valve 66 is biased to its first (open) position, at which the implement cylinders 18 are hydraulically connected to the actuators and fluid reservoir as described above. While the control valve 66 is described as a pilot operated valve, it should be understood that the control valve 66 could also be embodied in an electrohydraulic valve adapted to receive electrical control signals directly from the controller 24**.

It should be appreciated that the system is designed so that if the pilot valve 64 fails, the control valve 66 is biased to its closed position. This enables efficient use of the implement cylinders in the event the pilot valve 64 fails. Additionally, it should be appreciated that the pilot valve 64 and control valve 66 could be arranged in different configurations without departing from the scope of the present invention. For example, a control valve could be employed which opens in response to receiving the hydraulic pilot pressure and closes in the absence of pilot supply pressure.

A kickout means is provided for selecting a desired kickout position and responsively producing a kickout position signal. The kickout means includes a kickout set switch 70 which is used in connection with the controller 24 to allow the operator to select the desired kickout heights described above. The kickout set switch 70 typically includes a push button 72 which is preferably mounted to the vehicle 12 at the operator's station. When the operator actuates the push button 72, the controller 24 reads the lift cylinder extension signal from the lift cylinder extension sensor 22 and preferably compares the magnitude of the cylinder extension signal to a predetermined magnitude corresponding to a lift extension midway between the maximum raised and lowered positions, (i.e., the midway point illustrated in FIG. 2.) If the lift cylinder extension signal is greater than the predetermined magnitude, the lift cylinder extension signal is stored in a non-volatile memory in the controller 24 at an upper kickout address (not shown). If the lift cylinder extension signal is less than the predetermined magnitude, the lift cylinder extension signal is stored in the non-volatile memory at a lower kickout address (not shown), and the controller 24 reads the tilt cylinder extension signal from the tilt cylinder extension sensor 23 and stores the signal in the non-volatile memory at a desired bucket position address. Thus, when the operator actuates the push button 72 when the lift arm assembly 14 is below the midpoint, signals are stored in memory which identify the desired location of a front portion of the bucket 16 when the implement is lowered.

In the preferred embodiment, the controller 24 is connected to a tilt detent mechanism (not shown). In the event that the bucket 16 is tilted below the position corresponding to the signal stored at the desired bucket position address and a tilt control lever (not shown) is moved to a rackback detent position, the tilt detent mechanism is actuated to maintain the control lever in that position. The tilt cylinder 20 responsively moves the bucket 16 toward the position defined by the signal stored at the desired bucket position address. As the bucket 16 is tilting, the controller 24 senses the tilt cylinder extension signal and deactivates the tilt detent mechanism in response to the tilt cylinder extension signal being substantially equivalent to the signal stored at the desired bucket position address. When the tilt detent mechanism is deactivated, the tilt control lever returns to a neutral position and the tilt cylinder 20 maintains the bucket 16 in substantially the same position with respect to the lift arm assembly 14.

Figure 4:
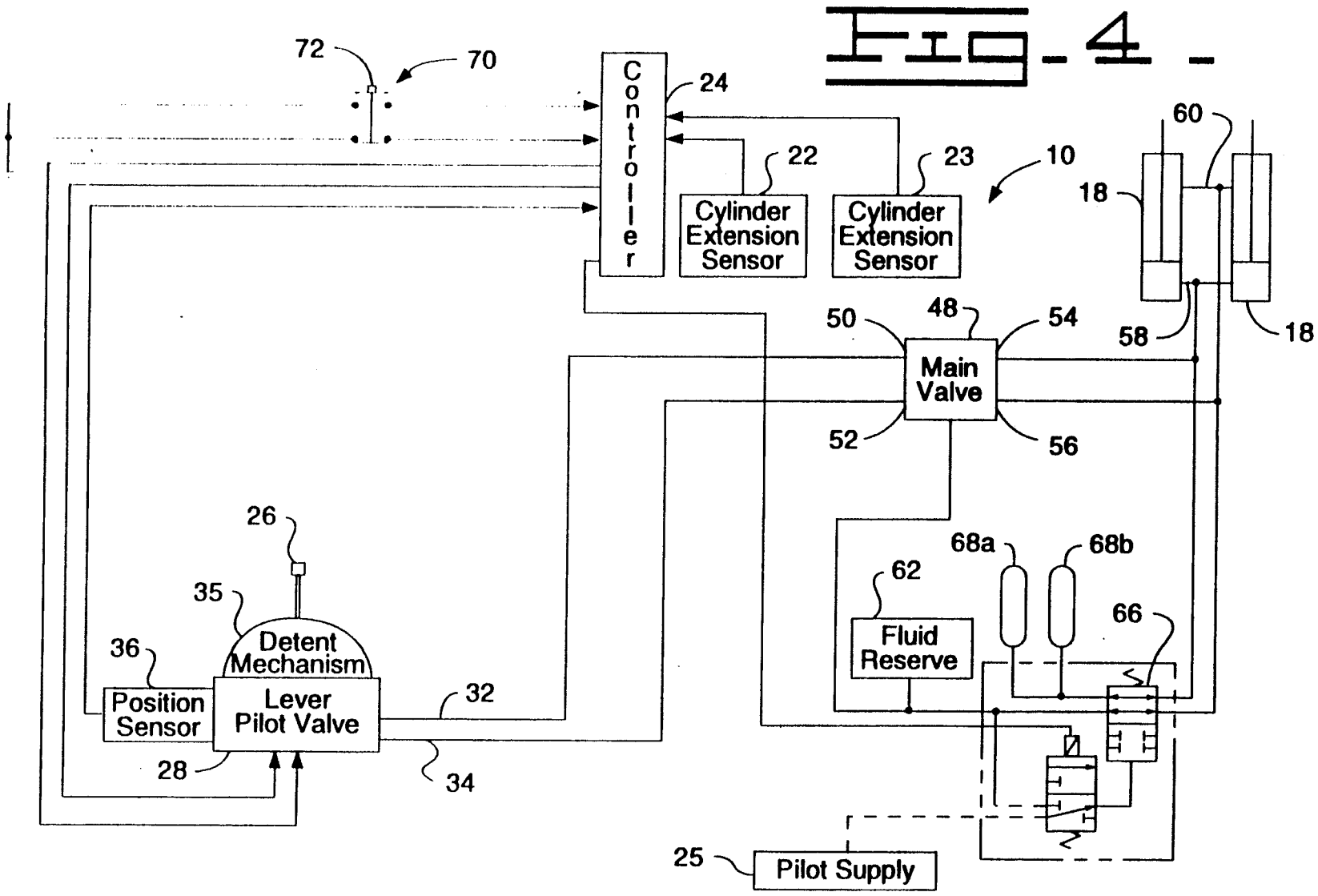
FIG. 4 is a diagrammatic illustration of a second embodiment of the present invention.

Referring now to FIG. 4, a second embodiment of the present invention will be briefly described. FIG. 3 and 4 contain many of the same components; therefore, like components have been referenced using the same reference numbers in both figures. The pilot supply valve 38, the pilot control valves 40,42 and the hydraulic resolvers 44,46 have been eliminated in the second embodiment. Therefore, the raise and lower pilot lines 32,34 are directly connected to the raise and lower input ports 50,52, respectively. The differences between operation of the first and second embodiments will be explained in greater detail below in connection with the descriptions of FIG. 5 and 6.

Figure 5:
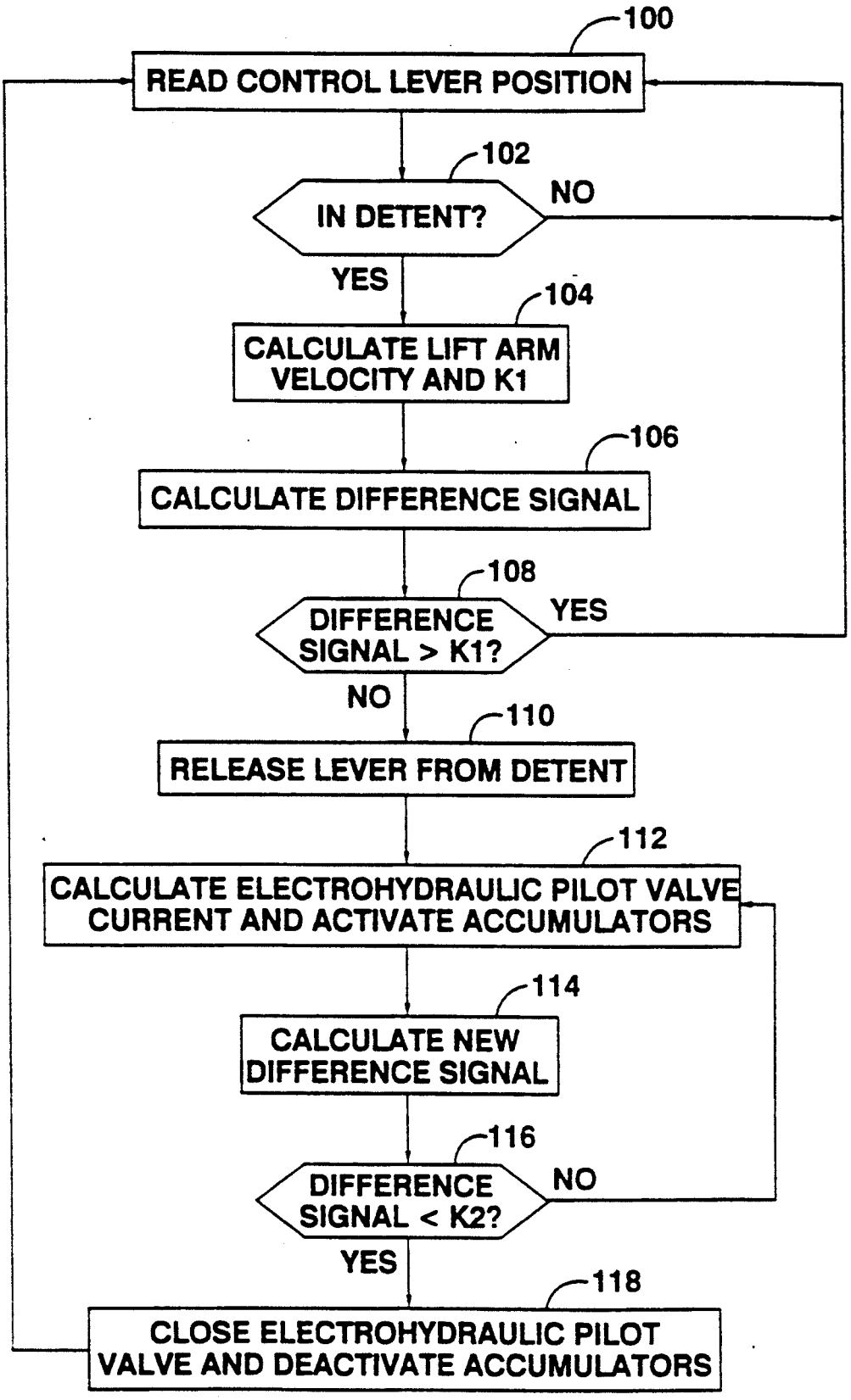
FIG. 5 is a flow chart illustrating certain features of the first embodiment of the present invention.
Figure 6:
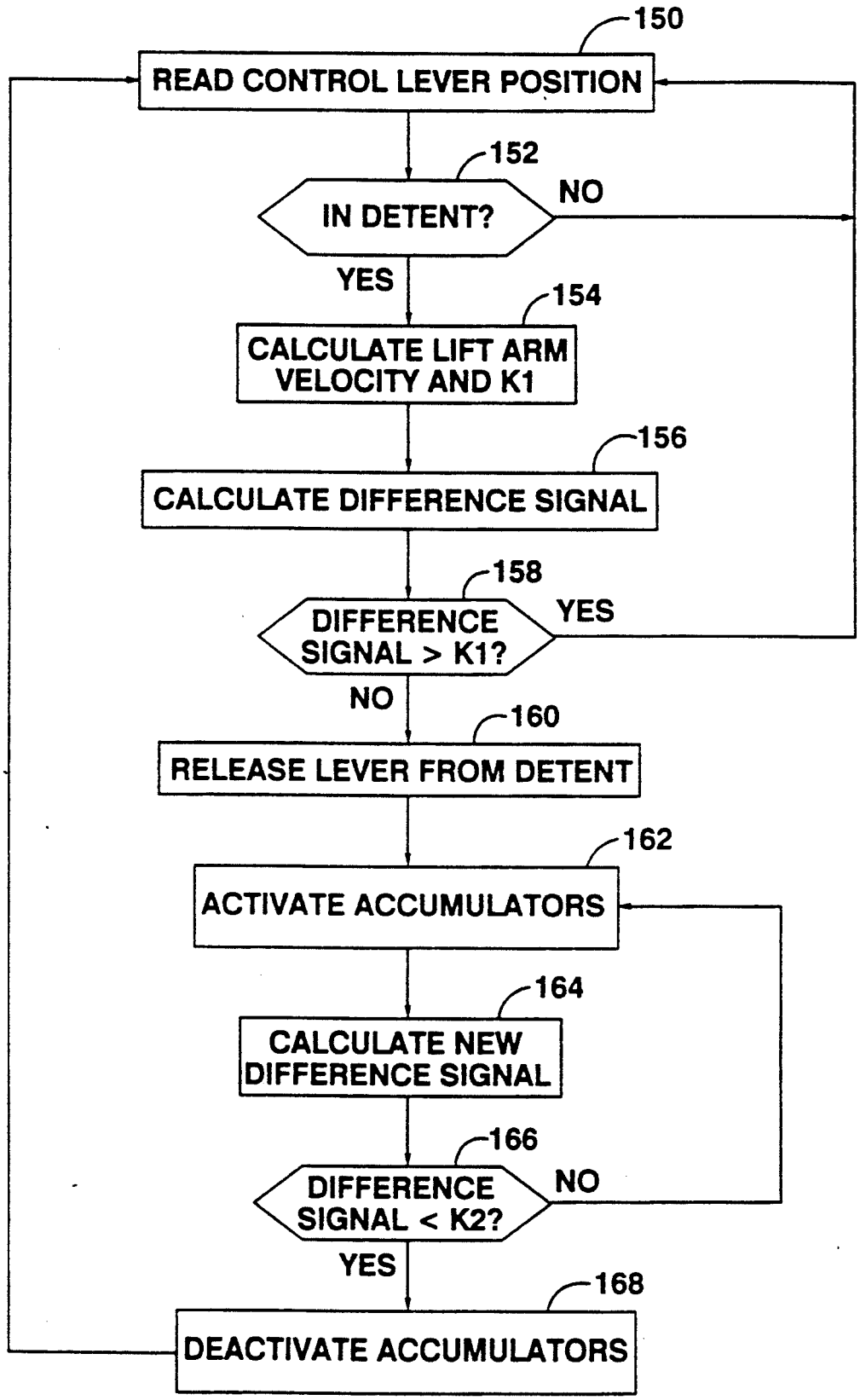
FIG. 6 is a flow chart illustrating certain features of the second embodiment of the present invention.

Referring now to FIGS. 5 and 6, embodiments of software for programming the controller 24 in accordance with certain aspects of the present invention is explained. FIGS. 5 and 6 represent flowcharts illustrating computer software subroutines for implementing the preferred embodiment of the present invention. The subroutines depicted in these flowcharts are particularly well adapted for use with the microprocessor and associated components described above, although any suitable microprocessor may be utilized in practicing the present invention. These flowcharts constitute a complete and workable design of the preferred software program. The software subroutines may be readily coded from these detailed flowcharts using the instruction set associated with this system, or may be coded with the instructions of any other suitable conventional microprocessor. The process of writing software code from flowcharts such as these is a mere mechanical step for one skilled in the art.

FIG. 5 is a flow chart illustrating certain features of the first embodiment (FIG. 3) of the present invention. FIG. 5 illustrates software which is used to reduce the speed of the implement as it reaches the lift and lower kickout heights. In connection with the description of FIG. 5, it is assumed that the operator has previously selected the lift kickout height and lower kickout height by respectively moving the lift arm assembly 14 to the desired dump and return to dig positions and activating the kickout set switch 70. Thus, cylinder extension signals are stored in the controller 24 at the respective upper and lower kickout addresses. It should be appreciated that default kickout heights may be stored in the controller memory. These default kickout heights can be accessed in the event that the operator does not select the raise and lower kickout heights via the kickout switch 70.

FIG. 5 will be described in connection with a lifting operation. Assume the operator moves the control lever 26 to extend the lift cylinders 18 and raise the bucket 16. When the control lever 26 is in the raise detent position, the lever pilot valve 28 is moved to its fully open position resulting in the maximum lever pilot pressure being directed to the resolver 44. In the block 100, the controller 24 reads the lever position signal from the control lever position sensor 36. Next in the block 102, it is determined whether the control lever 26 is in a detent position. This function is performed by comparing the lever position signal to signals having predetermined magnitudes which correspond to the lever position signal when the control lever 26 is in the raise and lower detent positions. If the lever 26 is not in a detent position, control is returned to the block 100. Conversely, if the lever 26 is in one of the detent positions, the controller 24 delivers a control signal of a preselected magnitude to the appropriate electrohydraulic pilot valve 40, 42 and control is passed to the block 104. In the case of a lifting operation, the controller 24 delivers a preselected current to the raise pilot valve 40. The magnitude of the current is selected such that the electrohydraulic pilot valve 40 is opened sufficiently to produce a pilot pressure having a pressure substantially equivalent to or slightly less than the pressure of the maximum lever pilot pressure. Since the lever operated pilot pressure exceeds the electrohydraulic pilot pressure, the resolver 44 directs the lever operated pilot pressure to the main valve 48.

In the block 104, the controller determines the lift arm velocity in response to recently sampled cylinder extension signals. Preferably, the lift arm velocity is calculated by differentiating the cylinder extension signal, as would be apparent to one skilled in the art. The controller 24 further determines a first threshold K1 as a function of lift arm velocity. The first threshold K1 is chosen to reflect the difference between the kickout begin-modulation-position and the associated kickout height (i.e., a modulation region.) Preferably the first threshold K1 is calculated to provide a substantially larger stopping distance with increasing lift arm velocity. A relatively large difference signal infers a gradual stopping of the lift arm assembly 14, whereas a relatively small difference signal infers bringing the lift arm assembly 14 to a stop in a relatively short distance. It should be appreciated that the first threshold K1 may also be determined in response to other sensed parameters, such as implement acceleration.

Control is then passed to the block 106 where a difference signal is calculated by the controller 24. In the preferred embodiment, calculation of the difference signal entails determining whether the control lever 26 is positioned to cause the lift arm assembly to raise or to lower, reading the present lift cylinder extension signal, selecting the appropriate raise or lower kickout address in response to the position of the control lever 26, and determining the difference between the present lift cylinder extension signal and the lift cylinder extension signal in the selected kickout address (i.e., the kickout height.)

After the difference signal is calculated, control is passed to the block 108 where the difference signal is compared to the first threshold value K1. If the difference signal is greater than the first threshold K1, the lift arm assembly 14 is not between the kickout begin-modulation-position and the associated kickout height and control is returned to the block 100. Conversely, if the difference signal is less than or equal to the threshold K1, the lift arm assembly 14 is between the kickout begin-modulation-position and the associated kickout height and control is passed to the block 110.

In the block 110, the controller 24 produces a detent release signal which causes the detent mechanism 26 to release the control lever 26 from its detent position. When the control lever 26 is released, it is biased to the neutral position, thereby closing the lever operated pilot valve 28. As was mentioned above, the control signal is maintained at a preselected magnitude when the control lever is in a detent position. Alternatively, the electrohydraulic valves 40,42 could be maintained in their closed positions and then moved to the preselected magnitude when the lever 26 is released from detent. As the lever pilot pressure begins to decrease it drops below the magnitude of the electrohydraulic pilot pressure. As a result, the resolver 44 directs the electrohydraulic pilot pressure to the main valve 48 in place of the lever pilot pressure. The former method is preferred because it assures a smooth modulation process.

Control is then passed to the block 112 which marks the beginning of a modulation process. In the block 112 the controller 24 recalculates the magnitude of the control signal to be delivered to the raise electrohydraulic pilot valve 40. Preferably the control signal is proportionally reduced as the difference signal decreases. It should be appreciated other control strategies, such as a PID control, could readily be employed for calculating the control signal.

Additionally in the block 112, the controller delivers the "open" signal to the pilot valve 64, thereby activating the accumulators 68*a,b*. More specifically, the "open" signal biases the pilot valve 64 to its second position, thereby cutting the pilot supply pressure to the control valve 66. In the absence of the pilot supply pressure, the control valve 66 is biased to its first (open) position and the implement cylinders 18 are hydraulically connected to the actuators 68 and fluid reservoir 62 as described above. Operating the accumulators 68 during the modulation process is advantageous because smoother modulation can be achieved. This is because the accumulators 68 cushion movement of the lift cylinders by absorbing shocks and pressure spikes in the hydraulic circuit.

Control is then passed to the block 114 where the controller 24 recalculates the difference signal. Next control is passed to the block 116 where the controller 24 compares the recalculated difference signal to a second threshold K2. The second threshold K2 corresponds to a deadband region prior to the kickout height which is selected to prevent the implement from overshooting the kickout height. If the difference signal indicates that the implement is within the deadband region, control is passed to the block 118 where the electrohydraulic pilot valve 40 is closed and the accumulators 68 are deactivated, thereby stopping movement of the lift arm assembly 14.

Conversely, if the difference signal is greater than the second threshold K2, control is returned to the block 112 where the electrohydraulic pilot valve control signal is calculated as a function of the new difference signal and the magnitude of the control signal that was sent to the electrohydraulic pilot valve at the beginning of the modulation process. As was mentioned above, the electrohydraulic pilot valve control signal is preferrably directly proportional to the distance from the implement to the lift kickout height. As a result, the electrohydraulic pilot valve 40 is progressively closed and the implement velocity is gradually reduced as the implement approaches the kickout height.

Referring now to FIG. 6, a flow chart illustrating certain features of the second embodiment (FIG. 4) of the present invention is described. FIG. 6 illustrates a second embodiment of software which is used to reduce the speed of the implement as it reaches the lift and lower kickout heights. As was mentioned above, the second embodiment differs from the first embodiment in that the pilot supply valve 38, the pilot control valve 40,42 and the resolvers 44,46 have been eliminated. In the second embodiment, modulation is achieved solely by activating the accumulators 68. This embodiment provides adequate modulation control while avoiding the costs and complexity associated with eliminated components. Operation of the second embodiment is identical to that of the first embodiment, except that the electrohydraulic valves are no longer activated in the modulation region. Rather, only the accumulators 68 are activated during the modulation region (i.e. when the difference signal is between the first and second thresholds K1, K2).

A third embodiment of the present invention will now be briefly described. The hardware for employing the third embodiment is essentially the same as that shown in FIG. 3, hence no drawing is shown for the third embodiment. The third embodiment, is a purely electrohydraulic system wherein movement of the lift arm assembly 14 is controlled solely by the raise and lower hydraulic pilot control valves 40,42. Hence, the lever pilot valve 28, the pilot lines 32, 34 and the hydraulic resolvers 44,46 are eliminated in the third embodiment. The pilot pressures supplied by the raise and lower electrohydraulic pilot control valves 40,42 are supplied directly to the raise and lower input ports 50,52, respectively, to control the position of the lift arm assembly 14.

A software flowchart is not shown for the third embodiment because the software flowchart is essentially the same as FIG. 5. In the third embodiment, the raise and lower electrohydraulic pilot valves 40,42 are normally maintained at their fully closed positions. When the operator moves the control lever to one of the detent positions, the appropriate raise or lower pilot control valve 40,42 is moved to its fully open position. The control valve 40,42 is maintained at its fully open position until the lift arm 14 assembly reaches the modulation region. When the lift arm assembly 14 reaches the modulation region (i.e., when the difference signal is between the first and second thresholds K1, K2), the accumulators 68 are activated and the magnitude of the electrohydraulic pilot valve control signal is gradually reduced as was explained above in connection with FIG. 5. Once the difference signal drops below the second threshold K2, the accumulators 68 are deactivated and the pilot control valve 40,42 is moved to its fully closed position. It is conceivable that the third embodiment could readily be adapted for controlling the absolute position of the implement, as opposed to being employed solely in connection with the kickout operation. More specifically, the control lever 26 could be replaced with a lever which is not spring biased to neutral. Operation of the controller 24 would be much the same as described in connection with the kickout function; however, the controller 24 would be operative to position the implement at the desired position as indicated by the relative position of the control lever 26 within its range of movement. In such an embodiment the controller 24 is operative to fully energize the appropriate pilot control valve 40, 42 until the lift arm reaches the modulation region, at which point the accumulators 68 are activated and the magnitude of the pilot valve control signal is controllably reduced. Given the above description, implementation of the third embodiment is a mere mechanical step for one skilled in the art; therefore, no further description of the third embodiment is provided.

When the functions described in FIGS. 5 and 6 are used to lower the implement to the lower kickout height, the controller 24 reads the tilt cylinder extension sensor 23 to determine whether the bucket 16 is tilted such that the front portion of the bucket 16 will impact the ground before the lift arm assembly 14 is lowered to the lower kickout height. To prevent this contingency, the controller 24 compares the tilt extension signal to determine if the bucket is tilted below a predetermined position. If the bucket is so positioned, the controller 24 compensates, i.e. increases, the value stored at the lower kickout address. The compensated lower kickout position signal is calculated such that when the lift arm assembly 14 is in the position defined by the compensated lower kickout position signal, the front portion of the bucket 16 is substantially located at the position defined by the uncompensated lower kickout position signal and the desired bucket position. In the event that buckets of various sizes and shapes are used in connection with a vehicle including the instant invention, the bucket extending the largest distance from the lift arm assembly is advantageously used to select the bucket position defined by the predetermined signal.

The modulation function described in connection with FIGS. 5 and 6 is also operable to gradually slow the lift arm assembly when it is at or above the lift kickout height and the control lever 26 is moved to the raise detent position. In this situation, the controller 24 uses the maximum lift height in place of the lift kickout height and the first threshold K1 is chosen in response to the maximum lift height and the position at which modulation is to begin. In addition the second threshold K2 is substantially at or less than zero since it is advantageous for the lift arm assembly to lightly impact the mechanical stop thus providing feedback to the operator that the lift arm assembly is at the maximum lift height.

At any time that the control lever 26 is engaged with the detent mechanism 26, the operator may regain control of the control lever 26 by exerting a force on the control lever 26 toward the neutral position. When the force exerted by the operator exceeds that of the detent mechanism 26, the control lever 26 begins to move toward the neutral position. The controller 24 senses the resulting control lever motion via the control lever position sensor 36 and produces the detent release signal to cause the detent mechanism 26 to release the control lever 26 from the detent position. As the detent mechanism 26 is released, the controller 24 substantially closes the electrohydraulic pilot valves 40,42 to return control of the implement to the operator.

INDUSTRIAL APPLICABILITY

Vehicles such as wheel type loaders include work implements capable of being moved through a number of positions during a work cycle. The typical work cycle associated with a bucket includes positioning the bucket and associated lift arm assembly in a digging position for filling the bucket with material, a carrying position, a raised position, and a dumping position for removing material from the bucket.

The present invention provides a method and apparatus for progressively slowing the velocity of the implement during a work cycle rather than abruptly stopping or changing the velocity of the implement. Such a function is particularly worthwhile to slow the implement before it reaches a kickout position and to slow the implement before a mechanical stop impacts a portion of the lift arm assembly 14 or lift cylinders 18.

It should be understood that while the function of the preferred embodiment is described in connection with the lift arm assembly 14 and associated hydraulic circuits, the present invention is readily adaptable to control the position of other types of implements. For example, the present invention could be employed to control implements on hydraulic excavators, backhoes, and similar vehicles having hydraulically operated implements.

It should be further understood that the present invention has been described in connection with a pilot operated hydraulic system by way of illustration and not limitation. The present invention is equally operable in systems in which the main valve 48 is omitted and the resolvers 44,46 are connected directly to the hydraulic cylinders.

Other aspects, objects, and advantages of this invention can be obtained from a study of the drawings, the disclosure, and the appended claims.

I claim:

1. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

kickout means for selecting a kickout position and responsively producing a kickout position signal;

a control lever being normally biased to a neutral position and being movable between raise and lower detent positions;

a lever position sensor adapted to sense the position of the control lever and responsively produce a lever position signal;

a lever operated pilot valve connected to the control lever and being adapted to produce a lever pilot pressure responsive to the position of the control lever;

a detent mechanism being adapted to maintain the control lever at either of its detent positions when the control lever is manually moved to a respective detent position, the detent mechanism being further adapted to receive a detent release signal and release the control lever from the detent position in response to the detent release signal;

a controller being adapted to receive the implement and control lever position signals, produce a detent signal in response to the control lever position signal indicating that the control lever is in one of the detent positions, produce a difference signal in response to a difference between the implement and kickout position signals, produce an open signal and the detent release signal when the difference signal between first and second thresholds, and produce a control signal in response to production of the detent signal, the control signal having a magnitude responsive to the difference signal;

an accumulator control means for receiving the open signal and permitting hydraulic fluid flow between the hydraulic cylinder and the accumulator in response to the open signal and preventing hydraulic fluid flow between the hydraulic cylinder and the hydraulic accumulator in the absence of the open signal;

first valve means for receiving the control signal and producing an electrohydraulic pilot pressure in response to the control signal; and second valve means for receiving the lever and electrohydraulic pilot pressures and controlling the extension of the hydraulic cylinder in response to the greater of the two pressures.

2. An apparatus as set forth in claim 1, wherein the accumulator control means includes an accumulator control valve connected between the hydraulic accumulator and the hydraulic cylinder, the accumulator control valve being movable to a first position at which hydraulic fluid passes between the hydraulic cylinder and the accumulator in response to the open signal and being biased to a second position at which hydraulic fluid is prevented from passing between the lift cylinder and the hydraulic accumulator in the absence of the open signal.

3. An apparatus as set forth in claim 2, including a fluid reservoir connected to the accumulator control valve, wherein the hydraulic cylinder has a rod end and a head end, and wherein hydraulic fluid flow is permitted between the rod end and the fluid reservoir and between the head end and the accumulator when the accumulator control valve is at its first position and hydraulic fluid flow between the rod end and the accumulator and between the head end and the fluid reservoir is prevented when the accumulator control valve is at its second position.

4. An apparatus, as set forth in claim 1, wherein the controller includes upper and lower kickout position addresses and wherein the controller stores the kickout position signal at the upper kickout address when the kickout position signal exceed a predetermined value and at the lower kickout address when the kickout position signal is less than the predetermined value and wherein the predetermined values corresponds to a lift extension midway between the maximum raised and lowered positions.

5. An apparatus as set forth in claim 1, wherein the controller produces an implement velocity signal in response to the implement position signal and wherein the first threshold is selected as a function of the implement velocity signal.

6. An apparatus as set forth in claim 5, wherein the magnitude of the first threshold increases with increasing implement velocity.

7. An apparatus as set forth in claim 1, wherein the control signal is proportional to the difference signal.

8. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

kickout means for selecting a kickout position and responsively producing a kickout position signal;

a control lever being normally biased to a neutral position and being movable between raise and lower detent positions;

a lever position sensor adapted to sense the position of the control lever and responsively produce a lever position signal;

a lever operated pilot valve connected to the control lever and being adapted to produce a lever pilot pressure responsive to the position of the control lever;

a detent mechanism being adapted to maintain the control lever at either of its detent positions when the control lever is manually moved to a respective detent position, the detent mechanism being further adapted to receive a detent release signal and release the control lever from the detent position in response to the detent release signal;

a controller being adapted to receive the implement and control lever position signals, produce a detent signal in response to the control lever position signal indicating that the control lever is in one of the detent positions, produce a difference signal in response to a difference between the implement and kickout position signals, and produce an open signal and the detent release signal when the difference signal is between first and second thresholds;

an accumulator control means for receiving the open signal and permitting hydraulic fluid flow between the hydraulic cylinder and the accumulator in response to the open signal and preventing hydraulic fluid flow between the hydraulic cylinder and the hydraulic accumulator in the absence of the open 15 signal;

valve means for receiving the lever pilot pressures and controlling the extension of the hydraulic cylinder in response to received pressure.

9. An apparatus as set forth in claim 8, wherein the accumulator control means includes an accumulator control valve connected between the hydraulic accumulator and the hydraulic cylinder, the accumulator control valve being movable to a first position at which hydraulic fluid passes between the hydraulic cylinder and the accumulator in response to the open signal and being biased to a second position at which hydraulic fluid is prevented from passing between the lift cylinder and the hydraulic accumulator in the absence of the open signal.

10. An apparatus as set forth in claim 8, including a fluid reservoir connected to the accumulator control means, wherein the hydraulic cylinder has a rod end and a head end, and wherein hydraulic fluid flow is permitted between the rod end and the fluid reservoir and between the head end and the accumulator when the accumulator control means is at its first position and hydraulic fluid flow between the rod end and the accumulator and between the head end and the fluid reservoir is prevented when the accumulator control valve is at its second position.

11. An apparatus, as set forth in claim 8, wherein the controller includes upper and lower kickout position addresses and wherein the controller stores the kickout position signal at the upper kickout address when the kickout position signal exceed a predetermined value and at the lower kickout address when the kickout position signal is less than the predetermined value and wherein the predetermined values corresponds to a lift extension midway between the maximum raised and lowered positions.

12. An apparatus as set forth in claim 8, wherein the controller produces an implement velocity signal in response to the implement position signal and wherein the first threshold is selected as a function of the implement velocity signal.

13. An apparatus as set forth in claim 12, wherein the magnitude of the first threshold increases with increasing implement velocity.

14. An apparatus as set forth in claim 8, wherein the control signal is proportional to the difference signal.

15. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

a means for producing a desired position signal which corresponds to a desired implement position;

a controller being adapted to receive the implement and desired position signals, produce a difference signal in response to a difference between the implement and desired position signals, produce an open signal when the difference signal is between first and second thresholds, and produce a control signal having a magnitude responsive to the difference signal, wherein the magnitude of the control signal is gradually reduced when the difference signal is between the first and second preselected thresholds;

an accumulator control means for receiving the accumulator open signal and permitting hydraulic fluid flow between the hydraulic cylinder and the accumulator in response to the open signal and preventing hydraulic fluid flow between the lift cylinder and the hydraulic accumulator in the absence of the open signal;

valve means for receiving the control signal and controlling the extension of the hydraulic cylinder in response to the magnitude of the control signal.

16. An apparatus as set forth in claim 15, including:

a control lever being normally biased to a neutral position and being movable between raise and lower detent positions;

a lever position sensor adapted to sense the position of the control lever and responsively produce the desired position signal.

17. An apparatus as set forth in claim 15, wherein the accumulator control means includes an accumulator control valve connected between the hydraulic accumulator and the hydraulic cylinder, the accumulator control valve being movable to a first position at which hydraulic fluid passes between the hydraulic cylinder and the accumulator in response to the open signal and being biased to a second position at which hydraulic fluid is prevented from passing between the lift cylinder and the hydraulic accumulator in the absence of the open signal.

18. An apparatus as set forth in claim 15 including a fluid reservoir connected to the accumulator control means, wherein the hydraulic cylinder has a rod end and a head end, and wherein hydraulic fluid flow is permitted between the rod end and the fluid reservoir and between the head end and the accumulator when the accumulator control means is at its first position and hydraulic fluid flow between the rod end and the accumulator and between the head end and the fluid reservoir is prevented when the accumulator control valve is at its second position.

19. An apparatus as set forth in claim 15, wherein the control signal is proportional to the difference signal.

20. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

a means for producing a desired position signal which corresponds to a desired implement position;

a controller being adapted to receive the implement and desired position signals, produce a difference signal in response to a difference between the implement and desired position signals, produce an open signal when the difference signal is between first and second thresholds, and produce a control signal having a magnitude responsive to the difference signal;

an accumulator control means for receiving the accumulator open signal and permitting hydraulic fluid flow between the hydraulic cylinder and the accumulator in response to the open signal and preventing hydraulic fluid flow between the lift cylinder and the hydraulic accumulator in the absence of the open signal;

valve means for receiving the control signal and controlling the extension of the hydraulic cylinder in response to the magnitude of the control signal;

a control lever being normally biased to a neutral position and being movable between raise and lower detent positions;

a lever position sensor adapted to sense the position of the control lever and responsively produce the desired position signal;

kickout means for selecting a kickout position and responsively produce a kickout position signal;

a detent mechanism being adapted to maintain the control lever at either of its detent positions when the control lever is manually moved to a respective detent position, the detent mechanism being further adapted to receive a detent release signal and release the control lever from the detent position in response to the detent release signal; and wherein the controller is adapted to receive the desired position, implement position, and detent release signals, produce a detent signal in response to the desired position signal indicating that the control lever is in one of the detent positions, and produce the difference signal in response to a difference between the implement and kickout position signals when the detent signal is produced.

21. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

a means for producing a desired position signal which corresponds to a desired implement position;

a controller being adapted to receive the implement and desired position signals, produce a difference signal in response to a difference between the implement and desired position signals, produce an open signal when the difference signal is between first and second thresholds, and produce a control signal having a magnitude responsive to the difference signal;

an accumulator control means for receiving the accumulator open signal and permitting hydraulic fluid flow between the hydraulic cylinder and the accumulator in response to the open signal and preventing hydraulic fluid flow between the lift cylinder and the hydraulic accumulator in the absence of the open signal;

valve means for receiving the control signal and controlling the extension of the hydraulic cylinder in response to the magnitude of the control signal; and wherein the controller includes upper and lower kickout position addresses and wherein the controller stores the kickout position signal at the upper kickout address when the kickout position signal exceed a predetermined value and at the lower kickout address when the kickout position signal is less than the predetermined value and wherein the predetermined values corresponds to a lift extension midway between the maximum raised and lowered positions.

22. An apparatus for controllably raising and lowering an implement which is connected to a work vehicle and movable between maximum raised and lowered positions in response to the extension and retraction of a hydraulic cylinder, comprising:

a hydraulic accumulator;

a sensor adapted to sense the position of the implement with respect to the work vehicle and responsively produce an implement position signal;

a means for producing a desired position signal which corresponds to a desired implement position;

a controller being adapted to receive the implement and desired position signals, produce a difference signal in response to a difference between the implement and desired position signals, produce an open signal when the difference signal is between first and second thresholds, and produce a control signal having a magnitude responsive to the difference signal;

an accumulator control means for receiving the accumulator open signal and permitting hydraulic fluid flow between the hydraulic cylinder and the accumulator in response to the open signal and preventing hydraulic fluid flow between the lift cylinder and the hydraulic accumulator in the absence of the open signal;

valve means for receiving the control signal and controlling the extension of the hydraulic cylinder in response to the magnitude of the control signal; and wherein the controller produces an implement velocity signal in response to the implement position signal and wherein the first preselected threshold is selected as a function of the implement velocity signal.

23. An apparatus as set forth in claim 22, wherein the magnitude of the first threshold increases with increasing implement velocity.

24. A method for controllably raising and lowering an implement which is connected to a work vehicle and movable between maximum raised and lowered positions in response to the extension and retraction of a hydraulic cylinder, the work vehicle including a control lever being normally biased to a neutral position and being movable between raise and lower detent positions, a detent mechanism being adapted to maintain the control lever at either of its detent positions when the control lever is manually moved to a respective detent position, the detent mechanism being further adapted to release the control lever from the detent position in response to the detent release signal, a kickout means for producing a kickout position signal and a hydraulic accumulator which is controllably connectable to the hydraulic cylinder for permitting fluid flow therebetween, comprising the steps of:

sensing the position of the implement with respect to the work vehicle and responsively producing an implement signal;

producing a lever pilot pressure responsive to the position of the control lever;

producing a detent signal in response to the control lever position signal indicating that the control lever is in one of the detent positions, producing a difference signal in response to a difference between the implement and kickout position signals;

producing an open signal and the detent release signal when the difference signal between first and second thresholds;

producing a control signal in response to production of the detent signal, the control signal having a magnitude responsive to the difference signal;

permitting hydraulic fluid flow between the hydraulic cylinder and the accumulator in response to the open signal;

preventing hydraulic fluid flow between the hydraulic cylinder and the hydraulic accumulator in the absence of the open signal;

producing an electrohydraulic pilot pressure in response to the control signal;

and controlling the extension of the hydraulic cylinder in response to the greater of the lever and electrohydraulic pilot pressures.

25. A method for controllably raising and lowering an implement which is connected to a work vehicle and movable between maximum raised and lowered positions in response to the extension and retraction of a hydraulic cylinder, the work vehicle including a control lever being normally biased to a neutral position and being movable between raise and lower detent positions, a detent mechanism being adapted to maintain the control lever at either of its detent positions when the control lever is manually moved to a respective detent position, the detent mechanism being further adapted release the control lever from the detent position in response to the detent release signal, a kickout means for producing a kickout position signal and a hydraulic accumulator which is controllably connectable to the hydraulic cylinder for permitting fluid flow therebetween, comprising the steps of:

sensing the position of the implement with respect to the work vehicle and responsively producing an implement signal;

sensing the position of the control lever and responsively producing a lever position signal;

producing a lever pilot pressure responsive to the position of the control lever;

producing a detent signal in response to the control lever position signal indicating that the control lever is in one of the detent positions, producing a difference signal in response to a difference between the implement and kickout position signals;

producing an open signal and the detent release signal when the difference signal between first and second thresholds;

permitting hydraulic fluid flow between the hydraulic cylinder and the accumulator in response to the open signal;

preventing hydraulic fluid flow between the hydraulic cylinder and the hydraulic accumulator in the absence of the open signal; and, controlling the extension of the hydraulic cylinder in response to the lever pilot pressure.

* * * * *